US009016815B2

(12) United States Patent
Morton

(10) Patent No.: US 9,016,815 B2
(45) **Date of Patent: *Apr. 28, 2015**

(54) PROTECTIVE CIRCUIT FOR INKJET PRINTHEAD

(71) Applicant: Eastman Kodak Company, Rochester, NY (US)

(72) Inventor: Christopher R. Morton, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 37 days.

This patent is subject to a terminal disclaimer.

(21) Appl. No.: 13/850,552

(22) Filed: Mar. 26, 2013

(65) Prior Publication Data

US 2014/0292856 A1 Oct. 2, 2014

(51) Int. Cl.
*B41J 29/38* (2006.01)
*B41J 2/045* (2006.01)

(52) U.S. Cl.
CPC ..... *B41J 2/04541* (2013.01); *B41J 2/0455* (2013.01); *B41J 2/0458* (2013.01)

(58) Field of Classification Search
CPC ..... B41J 2/04591
See application file for complete search history.

(56) References Cited

U.S. PATENT DOCUMENTS

| | | | | |
|---|---|---|---|---|
| 7,350,902 | B2 | 4/2008 | Dietl et al. | |
| 7,445,316 | B2 * | 11/2008 | Hirayama | 347/58 |
| 2012/0218334 | A1 * | 8/2012 | Bergstedt et al. | 347/11 |
| 2014/0292857 | A1 * | 10/2014 | Morton | 347/11 |

* cited by examiner

*Primary Examiner* — Justin Seo
(74) *Attorney, Agent, or Firm* — Peyton C. Watkins

(57) ABSTRACT

An inkjet printhead includes an array of resistive heaters; an array of nozzles associated with the array of resistive heaters; a heater voltage input for providing a heater voltage; a fire control pulse input for providing a fire control pulse having a first pulsewidth for controlling a length of time that current from the heater voltage input is allowed to pass through at least one of the resistive heaters; and a protective circuit configured to receive the fire control pulse from the fire control pulse input, and to override the fire control pulse if the first pulsewidth is greater than or equal to a predetermined length of time.

16 Claims, 11 Drawing Sheets

PROTECTIVE CIRCUIT FOR INKJET PRINTHEAD

CROSS REFERENCE TO RELATED APPLICATIONS

Reference is made to commonly assigned, co-pending U.S. patent application Ser. No. 13/850,571, concurrently filed herewith, entitled "Method for Protecting Inkjet Printhead from Long Pulses" by Christopher Morton, the disclosure of which is herein incorporated by reference.

FIELD OF THE INVENTION

This invention relates generally to the field of inkjet printheads, and more particularly to a protective circuit against overly long electrical pulses.

BACKGROUND OF THE INVENTION

A drop on demand inkjet printing system typically includes one or more printheads and their corresponding ink supplies. A printhead includes an ink inlet that is connected to its ink supply and an array of drop ejectors, each ejector including an ink pressurization chamber, an ejecting actuator and a nozzle through which droplets of ink are ejected. The ejecting actuator may be one of various types, including a resistive heater that vaporizes some of the ink in the chamber in order to propel a droplet out of the nozzle for the case of a thermal inkjet printhead. The droplets are typically directed toward paper or other print medium (sometimes generically referred to as recording medium or paper herein) in order to produce an image according to image data that is converted into electronic firing pulses for the drop ejectors as the print medium is moved relative to the printhead. The electronic firing pulses allow the passage of current through the resistive heater. The pulses are typically very short, on the order of a microsecond, and are of sufficient voltage to raise the temperature of the resistive heater to several hundred degrees Centigrade very quickly in order to form a vapor bubble for drop ejection. However, if the firing pulses are unintentionally too long, they allow current at high voltage to pass through the resistive heater for a length of time that causes overheating, thereby damaging the heater.

In addition to thermal inkjet printheads that have an array of resistive heaters for vaporizing ink to form bubbles to power drop ejection, there are other types of inkjet printheads that include arrays of resistive heaters. For example, a thermal actuator printhead causes drop ejection by rapidly heating a flipper formed by two materials having different coefficients of thermal expansion so that the heat causes a rapid bending motion to eject a drop. Furthermore, some types of continuous inkjet printheads include an array of resistive heaters that cause a stream of ink from the nozzles to break off into droplets of controlled sizes for subsequent printing of an image or for deflection from the path to the ink receiver.

All such printheads, as well as other types having resistive heater arrays, are susceptible to damaging of a heater if its electrical pulse is inadvertently left on for too long. Typically the pulsewidth of the electrical pulse is set by a controller in the printer. Normally the controller very reliably sets the appropriate pulsewidth. However, a hardware or firmware glitch, for example, can cause the pulsewidth not to turn off at the proper time, thereby damaging one or more heaters as described above.

Consequently, a need exists for a protective circuit for the inkjet printhead that protects the resistive heaters against inadvertently long electrical pulses.

SUMMARY OF THE INVENTION

The present invention is directed to overcoming one or more of the problems set forth above. Briefly summarized, according to one aspect of the invention, the invention resides in an inkjet printhead comprises an array of resistive heaters; an array of nozzles associated with the array of resistive heaters; a heater voltage input for providing a heater voltage; a fire control pulse input for providing a fire control pulse having a first pulsewidth for controlling a length of time that current from the heater voltage input is allowed to pass through at least one of the resistive heaters; and a protective circuit configured to receive the fire control pulse from the fire control pulse input, and to override the fire control pulse if the first pulsewidth is greater than or equal to a predetermined length of time.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
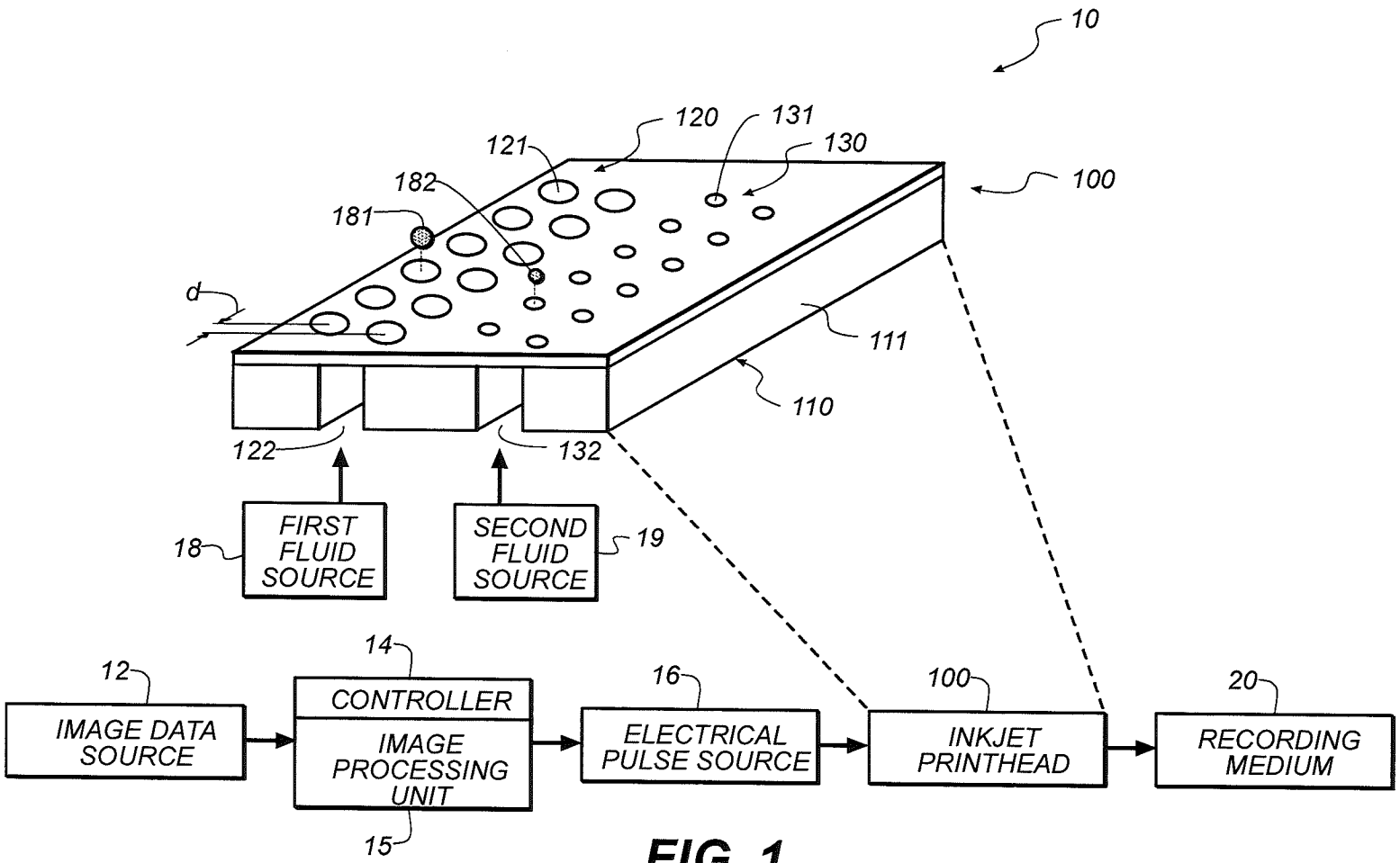
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. The inkjet printer system 10 includes an image data source 12, which provides data signals that are interpreted by a controller 14 as being commands to eject drops. The controller 14 includes an image processing unit 15 for rendering images for printing, and outputs signals to an electrical pulse source 16 of electrical energy pulses that in some embodiments are inputted as fire control pulses to an inkjet printhead 100, which includes at least one inkjet printhead die 110.

In the example shown in FIG. 1, there are two nozzle arrays. Nozzles 121 in a first nozzle array 120 have a larger opening area than nozzles 131 in a second nozzle array 130.

In this example, each of the two nozzle arrays 120, 130 has two staggered rows of nozzles 121, 131, each row having a nozzle density of 600 per inch. The effective nozzle density then in each array is 1200 per inch (i.e. d=1/1200 inch in FIG. 1). If pixels on a recording medium 20 were sequentially numbered along the paper advance direction, the nozzles 121, 131 from one row of an array would print the odd numbered pixels, while the nozzles 121, 131 from the other row of the array would print the even numbered pixels.

In fluid communication with each first and second nozzle array 120, 130 is a corresponding ink delivery pathway. Ink delivery pathway 122 is in fluid communication with the first nozzle array 120, and an ink delivery pathway 132 is in fluid communication with the second nozzle array 130. Portions of the ink delivery pathways 122 and 132 are shown in FIG. 1 as openings through a printhead die substrate 111. The one or more inkjet printhead die 110 will be included in the inkjet printhead 100, but for greater clarity only one inkjet printhead die 110 is shown in FIG. 1. The inkjet printhead die 110 are arranged on a mounting substrate member as discussed below relative to FIG. 2. In FIG. 1, first fluid source 18 supplies ink to the first nozzle array 120 via the ink delivery pathway 122, and a second fluid source 19 supplies ink to the second nozzle array 130 via the ink delivery pathway 132. Although distinct first fluid source 18 and distinct second fluid source 19 are shown, in some applications it may be beneficial to have a single fluid source supplying ink to both the first nozzle array 120 and the second nozzle array 130 via the ink delivery pathways 122 and 132 respectively. Also, in some embodiments, fewer than two or more than two nozzle arrays can be included on the inkjet printhead die 110. In some embodiments, all nozzles on the inkjet printhead die 110 can be the same size, rather than having multiple sized nozzles on the inkjet printhead die 110.

Not shown in FIG. 1, are the drop forming mechanisms associated with the nozzles 121, 131. Drop forming mechanisms can be of a variety of types, some of which include a heating element to vaporize a portion of ink and thereby cause ejection of a droplet, or an actuator which is made to move (for example, by heating a bi-layer element) and thereby cause ejection. In any case, electrical pulses, for example from the electrical pulse source 16, are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically, other aspects of the drop forming mechanisms (not shown) associated respectively with the first and second nozzle arrays 120 and 130 are also sized differently in order to optimize the drop ejection process for the different sized drops. During operation, droplets of ink are deposited on the recording medium 20.

Figure 2:
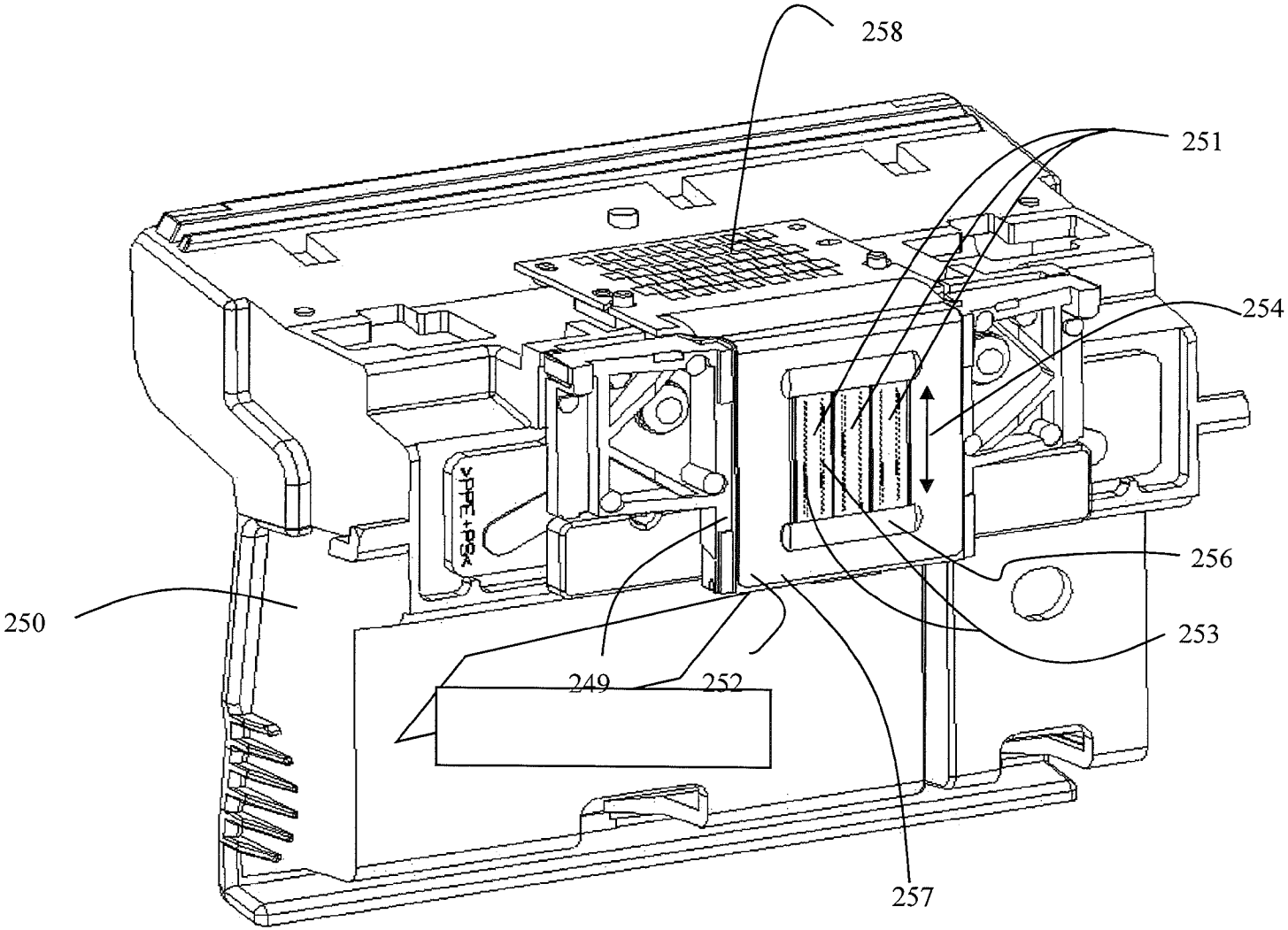
FIG. 2 is a perspective of a portion of a printhead.

FIG. 2 shows a perspective of a portion of a printhead 250, which is an example of the inkjet printhead 100. The printhead 250 includes three printhead die 251 (similar to the inkjet printhead die 110 in FIG. 1) mounted on a mounting substrate 249, each printhead die 251 containing two nozzle arrays 253, so that the printhead 250 contains six nozzle arrays 253 altogether. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along a nozzle array direction 254, and the length of each nozzle array 253 along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving the printhead 250 across the recording medium 20 (FIG. 1). Following the printing of a swath, the recording medium 20 is advanced along a media advance direction that is substantially parallel to the nozzle array direction 254.

Figure 5:
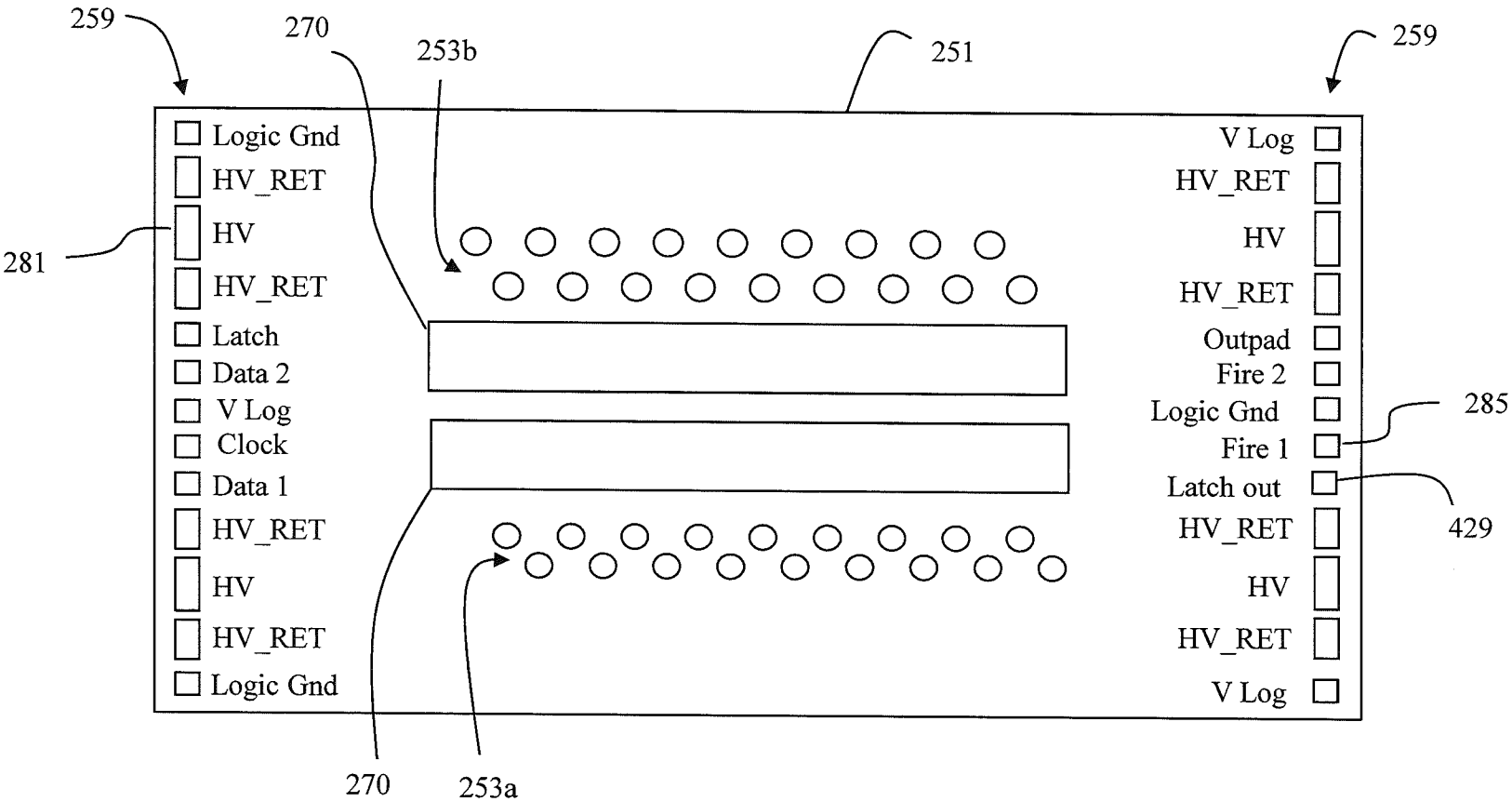
FIG. 5 is a sketch of a thermal inkjet printhead die.

The printhead die 251 are electrically interconnected to a flex circuit 257 on a printhead face 252, for example by wire bonding or TAB bonding to bond pads 259 (FIG. 5). The interconnections are covered by an encapsulating material 256 to protect them. The flex circuit 257 bends around the side of the printhead 250 and connects to the connector board 258. When the printhead 250 is mounted into a carriage 200 (see FIG. 3), the connector board 258 is electrically connected to a connector (not shown) on the carriage 200, so that electrical signals can be transmitted to the printhead die 251.

Figure 3:
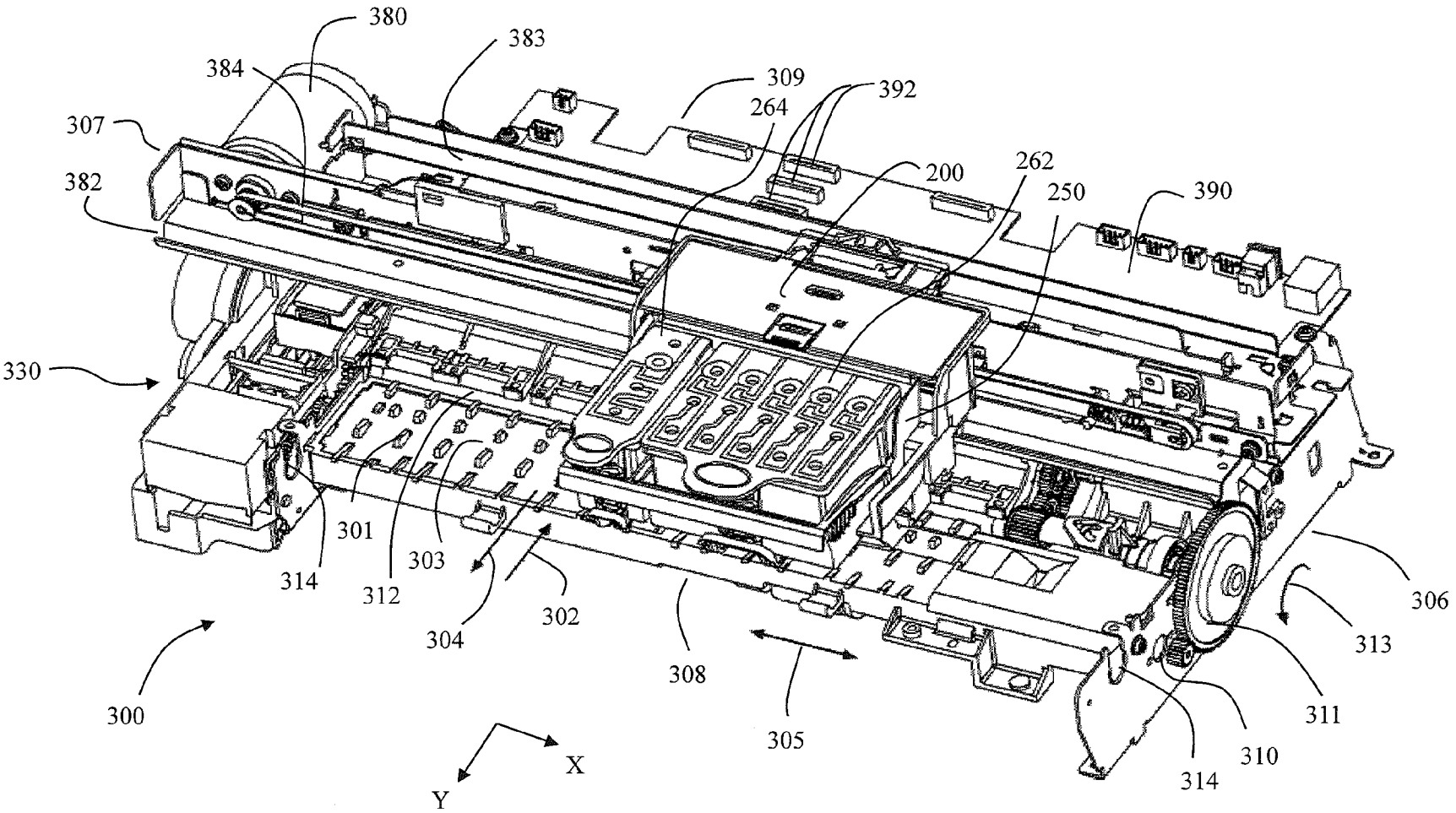
FIG. 3 is a perspective of a portion of a carriage printer.

FIG. 3 shows a portion of a desktop carriage printer. Some of the parts of the printer have been hidden in the view shown in FIG. 3 so that other parts can be more clearly seen. A printer chassis 300 has a print region 303 across which the carriage 200 is moved back and forth in a carriage scan direction 305 along the X axis, between a right side 306 and a left side 307 of the printer chassis 300, while drops are ejected from the printhead die 251 on the printhead 250 that is mounted on the carriage 200. A platen 301 (which optionally includes ribs) supports the recording medium 20 (FIG. 1) in the print region 303. Carriage motor 380 moves belt 384 to move the carriage 200 along carriage guide 382. An encoder sensor (not shown) is mounted on the carriage 200 and indicates carriage location relative to an encoder fence 383.

The printhead 250 is mounted in the carriage 200, and a multi-chamber ink supply 262 and a single-chamber ink supply 264 are mounted in the printhead 250. The mounting orientation of the printhead 250 is rotated relative to the view in FIG. 2, so that the printhead die 251 are located at the bottom side of the printhead 250, the droplets of ink being ejected downward toward the platen 301 in the print region 303 in the view of FIG. 3. The multi-chamber ink supply 262, in this example, contains five ink sources: cyan, magenta, yellow, photo black, and colorless protective fluid; while the single-chamber ink supply 264 contains the ink source for text black. Paper or other recording medium 20 (sometimes generically referred to as paper or print medium or media herein) is loaded along a paper load entry direction 302 toward the front of a printer chassis 308.

Figure 4:
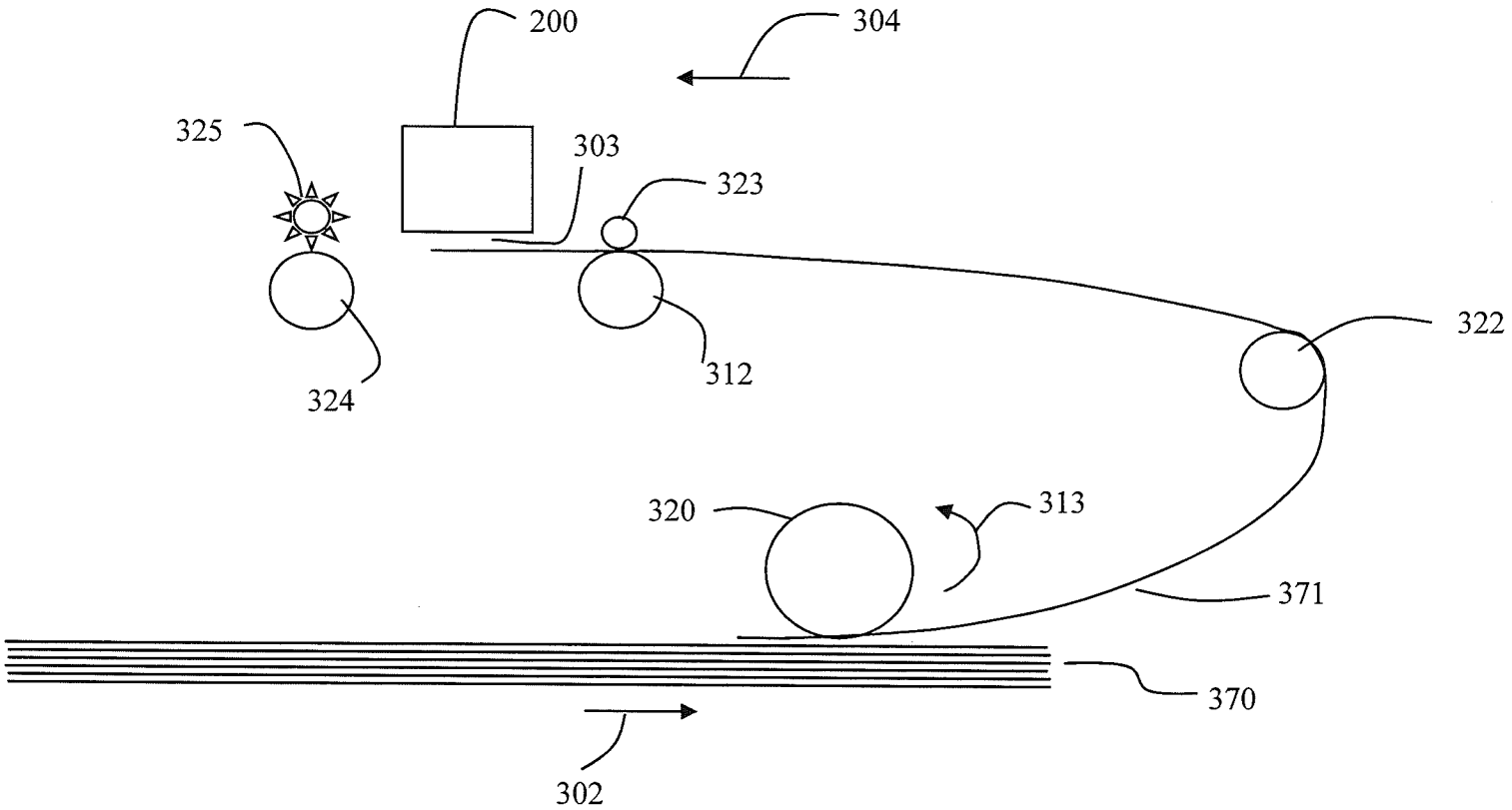
FIG. 4 is a schematic side view of an exemplary paper path in a carriage printer.

A variety of rollers are used to advance the recording 20 medium through the printer as shown schematically in the side view of FIG. 4. In this example, a pick-up roller 320 moves the top piece of medium or sheet 371 of a stack 370 of paper or other recording medium 20 in the direction of arrow, the paper load entry direction 302. A turn roller 322 acts to move the paper around a C-shaped path (in cooperation with a curved rear wall surface) so that the paper continues to advance along a media advance direction 304 from a rear 309 of the printer chassis (with reference also to FIG. 3). The paper is then moved by feed roller 312 and idler roller(s) 323 to advance along the Y axis across the print region 303, and from there to an output roller 324 and star wheel(s) 325 so that printed paper exits along the media advance direction 304. Feed roller 312 includes a feed roller shaft along its axis, and a feed roller gear 311 (see FIG. 3) is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

Referring to FIG. 3, the motor that powers the paper advance rollers is not shown, but a hole 310 at the right side of the printer chassis 306 is where the motor gear (not shown) protrudes through in order to engage the feed roller gear 311, as well as the gear for the output roller (not shown). Although the output roller 324 is not shown in FIG. 3, the shaft mounts 314 for the shaft of the output roller are shown. Referring to FIG. 4, for normal paper pick-up and feeding, it is desired that all rollers rotate in forward rotation direction 313 (FIG. 3). Feed roller 312 is upstream of the print region 303 and advances recording medium 20 toward the printing region prior to printing. Output roller 324 is downstream of the print region 303 and is for moving recording medium 20 away from the print region 303.

Referring back to FIG. 3, toward the rear of the printer chassis 309, in this example, is located the printer electronics board 390, which includes cable connectors 392 for communicating via cables (not shown) to the printhead carriage 200 and from there to the printhead 250. Also on the printer electronics board 390 are typically mounted motor controllers for the carriage motor 380 and for the paper advance motor, a clock pulse unit, a processor or other control electronics (shown schematically as the controller 14 and the image processing unit 15 in FIG. 1) for controlling the printing process, and an optional connector for a cable to a host computer. Toward the left side of the printer chassis 307 is a maintenance station 330 for keeping the nozzle arrays 253 (FIG. 2) in reliable printing condition.

Figure 6:
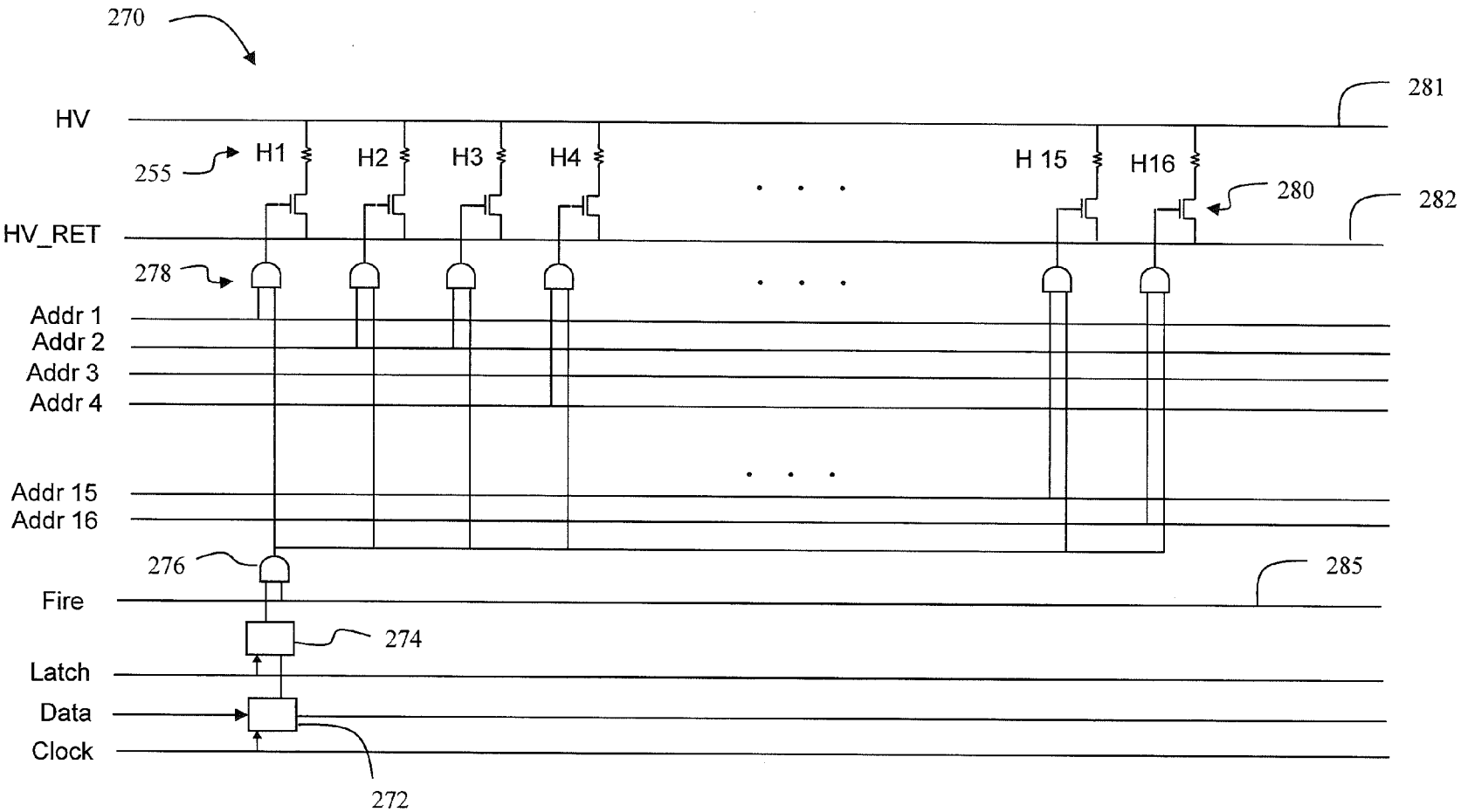
FIG. 6 is a schematic of a portion of the logic circuitry for the printhead die of FIG. 5.

FIG. 5 shows a sketch (not to scale) of the thermal inkjet printhead die 251 having two nozzle arrays 253*a* and 253*b*, as well as an integrated logic circuitry 270 for causing heaters associated with nozzle arrays 253*a* and 253*b* to turn on for ejecting drops of ink. The bond pads 259 are located at each end of the printhead die 251. Most of the bond pads 259 are input pads that have functions that can be described with reference to FIG. 6, which is a schematic of an example of a portion of the integrated logic circuitry 270. The portion of the integrated logic circuitry 270 shown in FIG. 6 is sometimes called a primitive. Each primitive corresponds to a group of heaters, for example the sixteen resistive heaters H1 to H16 (part of a resistive heater array 255) shown in FIG. 6. Each resistive heater H1 through H16 is associated a corresponding driver transistor 280. One end of each resistive heater H1 to H16 is connected to a heater voltage (HV) input 281 (typically around 20 to 30 volts), while the other end is connected to the drain of the corresponding driver transistor 280. The sources of the driver transistors 280 are connected to a current return input 282 (HV_RET), which may for example, be connected to ground. When a signal from one of the Address lines Addr1 to Addr16 turns a driver transistor 280 on current flows from the heater voltage input 281 through the corresponding resistive heater H1-H16 and driver transistor 280 to the current return input 282 (HV_RET). The primitive shown in FIG. 6 is replicated throughout the printhead die 251. For example, if there are twenty primitives each corresponding to a block of sixteen resistive heaters for the nozzles of nozzle array 253*a*, it would mean that there are 320 resistive heaters in the resistive heater array 255 and corresponding nozzles in nozzle array 253*a*. Because substantial current can flow from the heater voltage input 281 through the current return input 282 when multiple heaters (up to twenty in this example) from the different primitives are turned on at the same time, multiple, redundant heater voltage inputs 281 (HV) and the current return inputs 282 HV_RET are provided. During any one time interval, only one resistive heater in each primitive has current flowing through it for producing a vapor bubble in the ink. Which resistive heater can be pulsed is determined by signals on address lines Addr1 through Addr16. The signals on address lines Addr1 through Addr16 can be demultiplexed from the Data signal that is input at Data 1 (FIG. 5) for nozzle array 253*a* or at Data 2 for nozzle array 253*b*. Also provided by the Data signal is the image data for printing at a particular time. The Data line is connected to a serial shift register, only one shift register element 272 of which is shown in the primitive in FIG. 6. Also input into the shift register element 272 is a Clock line. In response to Clock pulses, the data on the Data line is shifted from one shift register element 272 to the next shift register element 272 in the next primitive that is similar to the primitive shown in FIG. 6. Once the data has been shifted to each shift register element 272, a Latch signal causes the data to be transferred to a parallel latch, only one parallel latch element 274 is shown in the primitive shown in FIG. 6. A fire control pulse is provided at a fire control pulse pad 285 from the electrical pulse source 16 (FIG. 1) and is ANDed with the data in the parallel latch element 274 at AND gate 276. The output of the AND gate 276 is sent in parallel to an array of AND gates 278 with the one AND gate 278 corresponding to each resistive heater H1 through H16 in the primitive. The other input of each AND gate 278 is one of the address lines Addr1 through Addr16. Each of the address lines Addr1 through ADDR16 is turned on sequentially. If, for example, when Addr1 is turned on, an on bit from Data line has been latched into the parallel latch element 274, then when fire control input pulse from the fire control pulse pad 285 is on, a driver transistor 280 corresponding to H1 will turn on, and current will pass through H1 for forming a vapor bubble and ejecting a drop of ink.

An undesirable event is that sometimes a fire control pulse is not turned off at the appropriate time, so that a heater such as H1 in the resistive heater array 255 is damaged or even burns out. Such an undesirable event can occur for example during firmware development for the controller 14 (FIG. 1). A firmware bug can result in the fire control pulse not turning off correctly.

Another undesirable event is that a hardware glitch can result in the fire control pulse not turning off correctly. In the example described above relative to FIG. 6, the fire control pulse is generated external to the printhead 250 at the electrical pulse source 16 (FIG. 1). In other printhead architectures (not shown), the fire control pulse is internally generated within the printhead, with the pulse width being determined by counting high frequency clock pulses for example. If there is an intermittent connection between the connector board 258 (FIG. 2) and the connector (not shown) on the carriage 200 (FIG. 3), such that the clock signal becomes disconnected, a fire control pulse that has been turned on fails to turn off. As a result, an inadvertently long pulse can damage one or more heaters in the resistive heater array 255.

Figure 7:
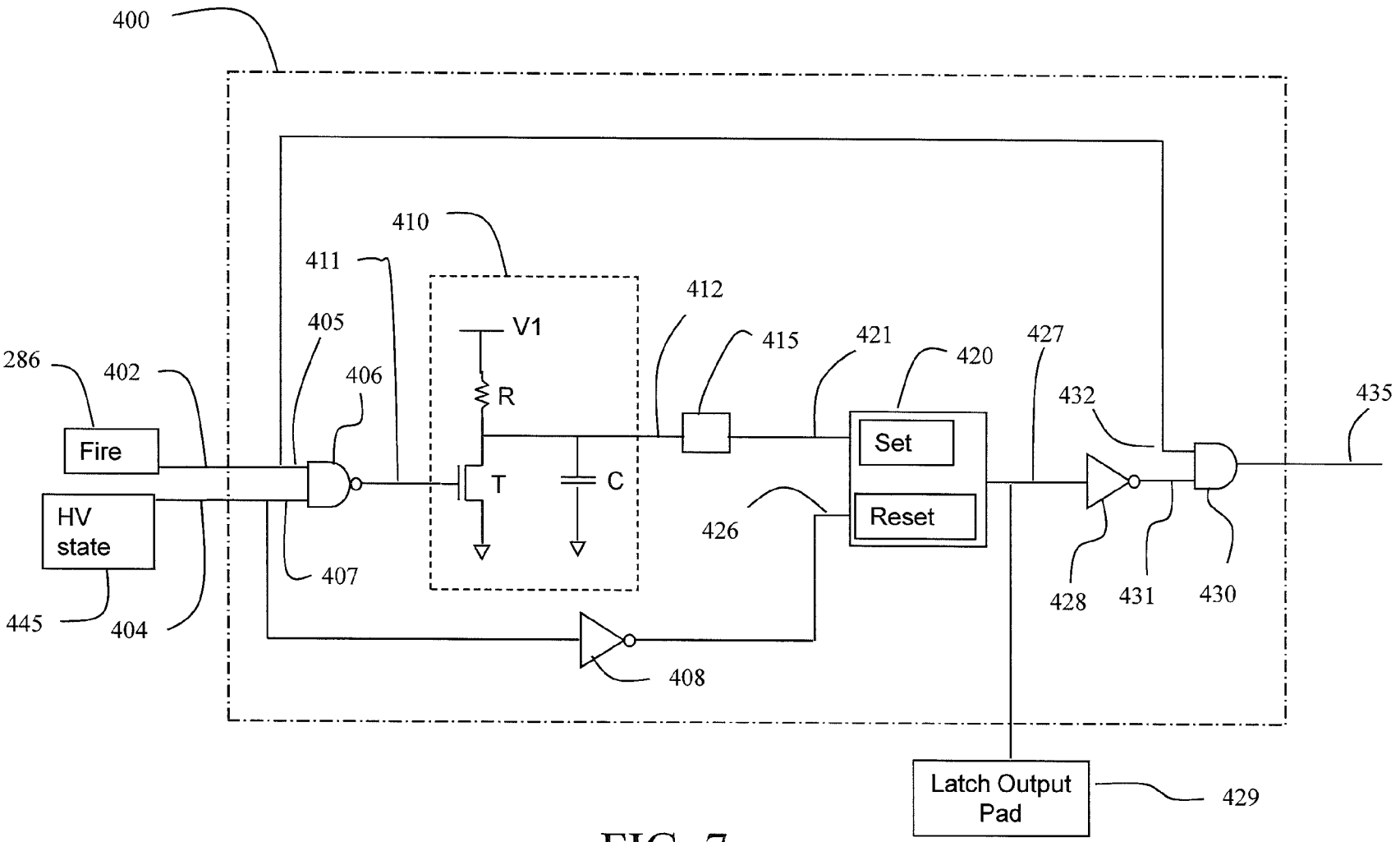
FIG. 7 is a schematic of a protective circuit according to a first embodiment of the invention.
Figure 8B:
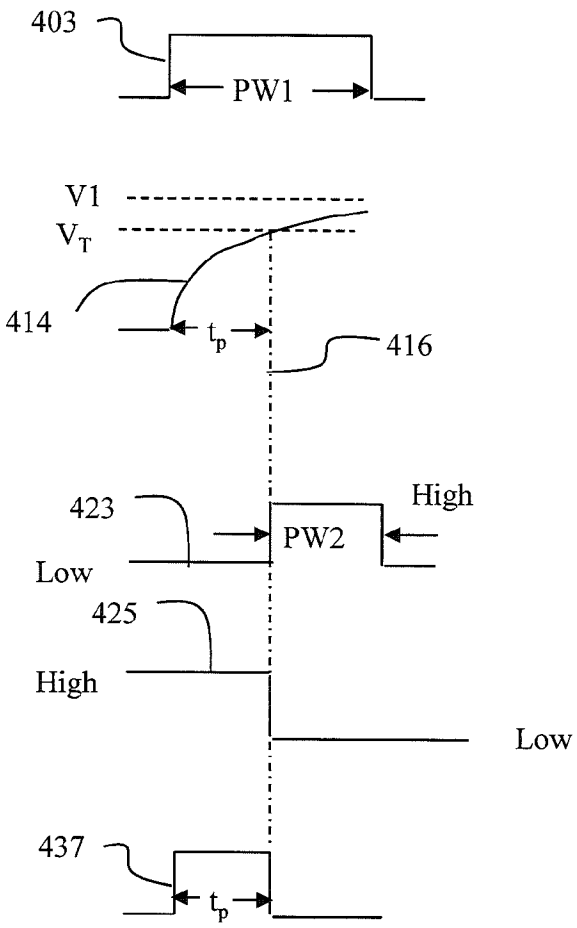
FIGS. 8A and 8B show voltage signals related to the protective circuit of FIG. 7.
Figure 8A:
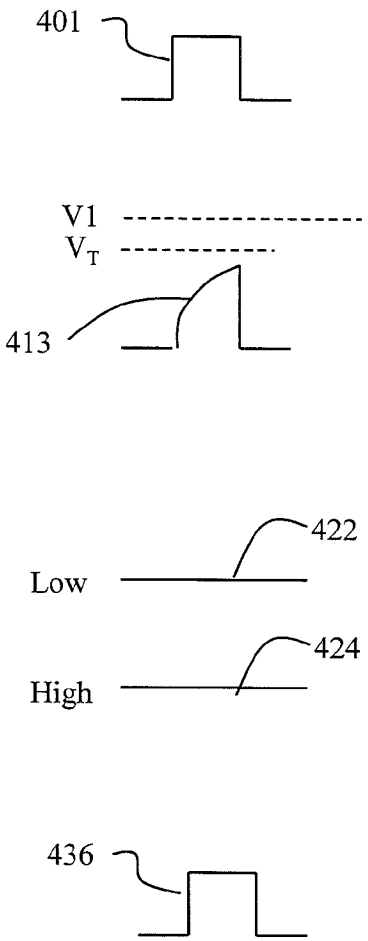

Embodiments of the present invention relate to protective circuitry that is configured to override the fire control pulse if its pulsewidth is greater than a predetermined length of time. FIG. 7 shows a schematic of a protective circuit 400 according to an embodiment of the present invention, and FIGS. 8A and 8B show electrical pulses relative to protective circuit 400 as described below. Typically, protective circuit 400 is included in the integrated circuit on the printhead die 251 (FIG. 5) that also includes the resistive heater array 255, the heater voltage input 281, and a fire control pulse input 286. In the example described above relative to FIG. 6, the fire control pulse input 286 (FIG. 7) is connected directly to the fire control pulse pad 285. In the example described above where the fire control pulse is internally generated, the fire control pulse input 286 is connected to the output of a fire pulse generation circuit (not shown). A first input 402 to protective circuit 400 is connected to the fire control pulse pad 285 (FIG. 6). A second input 404 to protective circuit 400 is connected to a heater voltage state indicator 445, which has a first state (e.g. high) if the voltage at the heater voltage input 281 is on and a second state (e.g. low) if the voltage at the heater voltage input 281 is off Second input 404 is also connected to inverter 408 which is connected to latch reset input 426 of set reset latch 420. Prior to printing, the voltage at the heater voltage input 281 is off, causing the heater voltage state indicator 445 to be low, so that the set reset latch 420 receives a high signal at latch reset input 426. This causes the latch output 427 of set reset latch 420 to be low until a high signal is received at latch set input 421 of set reset latch 420. As long as latch output 427 remains low, first input 431 to AND gate 430 will remain high, due to second inverter 428. Because first input 402 to protective circuit 400, which is connected to the fire control pulse input 286, is also connected to the second input 432 of AND gate 430, output 435 of protective circuit 400 will provide a pulse having the same width as the pulse provided at the fire control pulse input 286. Latch output 427 will only go high if a high signal is received at latch set input 421 while the heater voltage state indicator 445 is still high.

As discussed in further detail below, a high signal will only be received at latch set input 421 if a pulse provided at the fire control pulse input 286 is longer than a predetermined length of time. Pulses that are longer than the predetermined length of time will be overridden, thereby protecting the heaters in the resistive heater array 255 (FIG. 6) from damage, but allowing normal firing if the pulses are less than the predetermined length of time.

Consider first the behavior of protective circuit 400 (FIG. 7) if a properly controlled and not excessively long fire control input pulse 401 (FIG. 8A) is received at first input 402 during a time when heater voltage is on at the heater voltage input 281 (FIG. 6). First input 402 is connected to first logic gate input 405, and second input 404 is connected to second logic gate input 407 which are inputs to logic gate 406. In the example shown in FIG. 7 logic gate 406 is a NAND gate. The output of NAND gate 406 is the input 411 of a timer circuit 410 having a resistor R, a capacitor C and a transistor T. Input 411 of timer circuit 410 is low only if the fire control pulse input 286 is high and heater voltage state indicator 445 is also high (i.e. the heater voltage is turned on at the heater voltage input 281). Heater voltage state indicator 445 is high under the above assumption that the heater voltage is on at the heater voltage input 281. If input 411 of timer circuit 410 is high, transistor T is turned on so that output 412 of timer circuit 410 is low. If input 411 of timer circuit 410 is low, i.e. during a fire control input pulse 401 (FIG. 8A) while the heater voltage is turned on, then capacitor C begins to charge with a time constant determined by resistor R and capacitor C. As a result, the output 412 of timer circuit 410 has a timer circuit output pulse 413 (FIG. 8A) that approaches V1, which is typically equal to the logic voltage V Log (FIG. 5) of 5 volts. Under normal conditions as in FIG. 8A, where fire control input pulse 401 has its pulsewidth correctly controlled by the controller 14 (FIG. 1), there is not enough time for the voltage of timer circuit output pulse 413 to reach trigger voltage $V_T$. $V_T$ is the trigger voltage for a triggerable circuit element 415. Triggerable circuit element 415 can include two inverters in series, or it can be a Schmitt trigger, for example. Because the trigger voltage $V_T$ is not reached, the latch set input signal 422 (FIG. 8A) will remain low at latch set input 421, so that the latch output 427 will remain low. As a result input signal 424 (FIG. 8A) at first input 431 of AND gate 430 will remain high due to second inverter 428, and fire control input pulse 401 will not be overridden. A fire signal control pulse 436 having the same width as that of the fire control input pulse 401 will be provided at the output 435 of protective circuit 400.

Next consider the behavior of the protective circuit 400 if an excessively long fire control pulse 403 (FIG. 8B) is received at first input 402 while heater voltage is on at the heater voltage input 281 (FIG. 6). The primary difference in FIG. 8B relative to FIG. 8A is that long fire control pulse 403 having a pulsewidth PW1 provides enough time for capacitor C in timing circuit 410 to charge sufficiently to provide a timer circuit output pulse 414 having a voltage that exceeds trigger voltage $V_T$ after trigger point 416 is reached. Length of a time interval $t_p$ between the start of long fire control pulse 403 and trigger point 416 is predetermined by the values of resistor R, capacitor C, voltage level V1, and the trigger voltage $V_T$ of triggerable circuit element 415. In particular, since the RC charging of capacitor C is given by $$V=V1(1-\exp(-t/RC)),\text{then}$$

$$t_p=RC\ln(V1/(V1-V_T)).$$

When trigger voltage $V_T$ is reached at output 412 of timer circuit 410, latch set input signal 423 (FIG. 8B) at latch set input 421 will go high, which will cause latch output 427 of set reset latch input 421 to go high. The pulsewidth PW of latch set input signal 423 will be PW2, which is substantially equal to a difference between the pulsewidth PW1 of long fire control pulse 403 and the predetermined length of time $t_p$. Even after long fire control pulse 403 is turned off, latch output 427 will remain high so that input signal 425 to AND gate 430 will remain low, unless heater voltage at the heater voltage input 281 is turned off, thereby resetting set reset latch 420. A fire signal control pulse 437 having a pulsewidth equal to or substantially equal to the predetermined length of time $t_p$ from the start of long fire control pulse 403 until trigger point 416 is reached will thus be provided at the output 435 of protective circuit 400 when long fire control pulse 403 is provided at first input 402. The predetermined length of time $t_p$ is set such that heaters in the resistive heater array 255 will not be damaged.

As indicated above, until the heater voltage at the heater voltage input 281 is turned off again and heater voltage state indicator 445 goes low, no high signal will be sent to latch reset input 426 of set reset latch 420 and the first input 431 of AND gate 430 will remain low. As a result, if there are subsequent fire control pulses provided at first input 402 of protective circuit 400, no pulse will be provided at output 435 of protective circuit 400. In other words, the pulsewidth PW of the fire signal control pulse 436 at output 435 will be zero, i.e. it will be less than the predetermined length of time $t_p$. If the heater voltage at the heater voltage input 281 is turned off, a reset signal will be received at latch reset input 426 of set reset latch 420 so that latch output 427 will again go low and the protective circuit will again function as described above when the heater voltage is turned on.

Protective circuit 400 can also function as a diagnostic circuit for the printhead die 251 if an accessible latch output pad 429 (FIGS. 5 and 7) is provided. For example, if it is found that heaters in the resistive heater array 255 are not turning on, the output at latch output pad 429 can be checked prior to turning off the heater voltage at the heater voltage input 281. If the voltage at latch output pad 429 is high, then it is known that an excessively long fire control pulse 403 was provided, and causes for the overly long fire control pulse 403 can be investigated.

Figure 9:
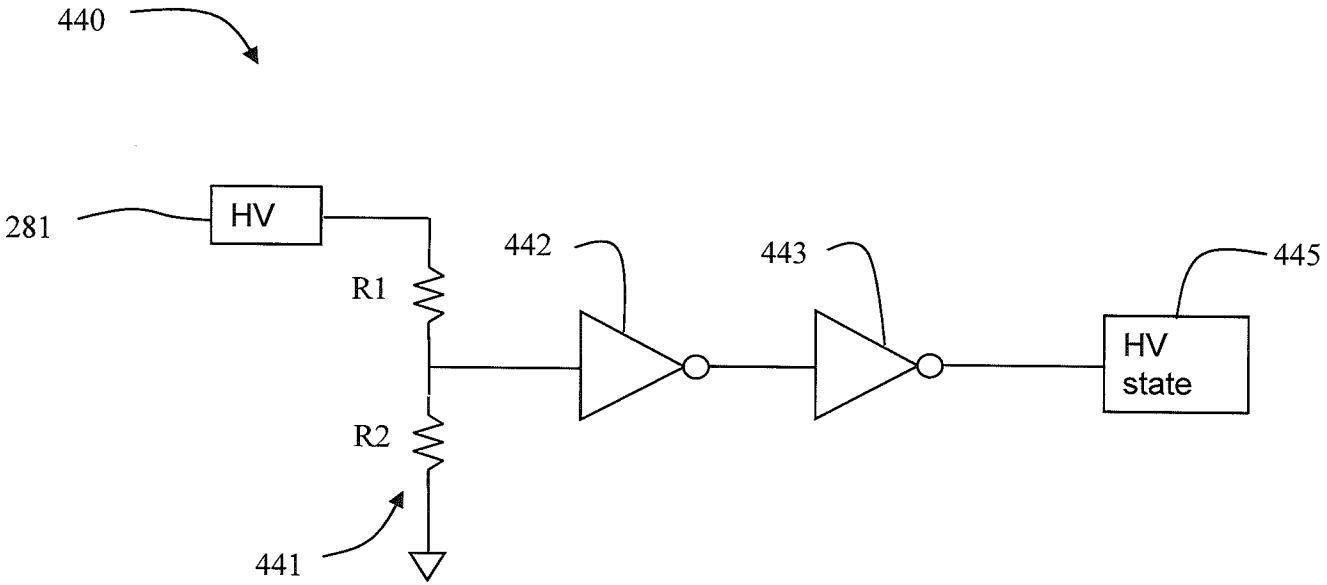
FIG. 9 is a schematic of a heater voltage status indicator.

FIG. 9 shows a schematic for a heater voltage state indicator circuit 440. The heater voltage input 281 (typically 20 to 30 volts) is input to a voltage divider 441 having resistors R1 and R2 leading to a pair of inverters 442 and 443. For example, if it is desired to have a voltage level of about 3 volts at heater voltage state indicator 445 when the heater voltage input 281 is on, the resistance of R1 is on the order of seven to ten times the resistance of R2 if the heater voltage is 20-30 volts. When the heater voltage input 281 is off, the voltage level at heater voltage state indicator 445 will be zero.

Figure 10:
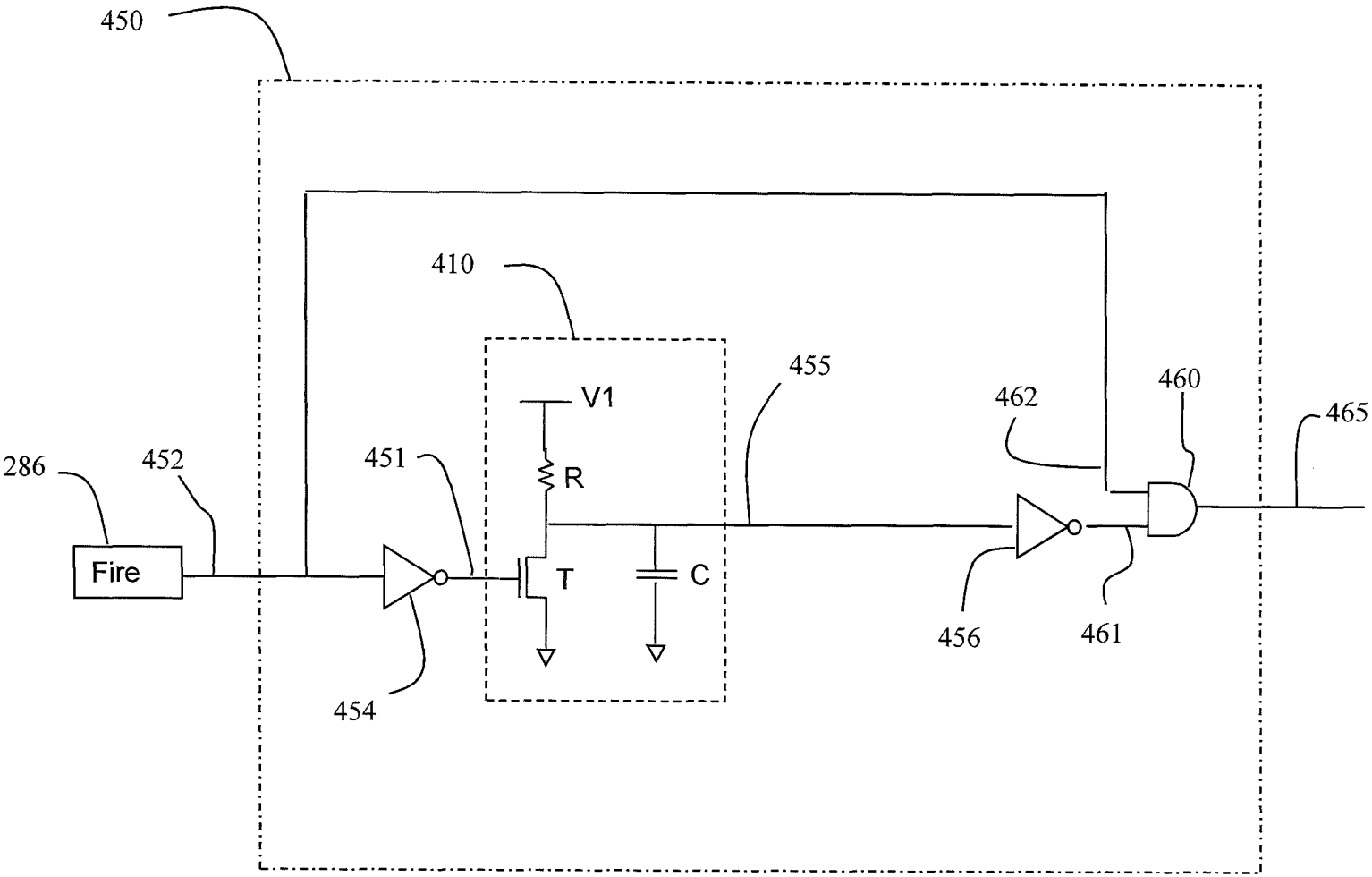
FIG. 10 is a schematic of a protective circuit according to a second embodiment of the invention.
Figure 11B:
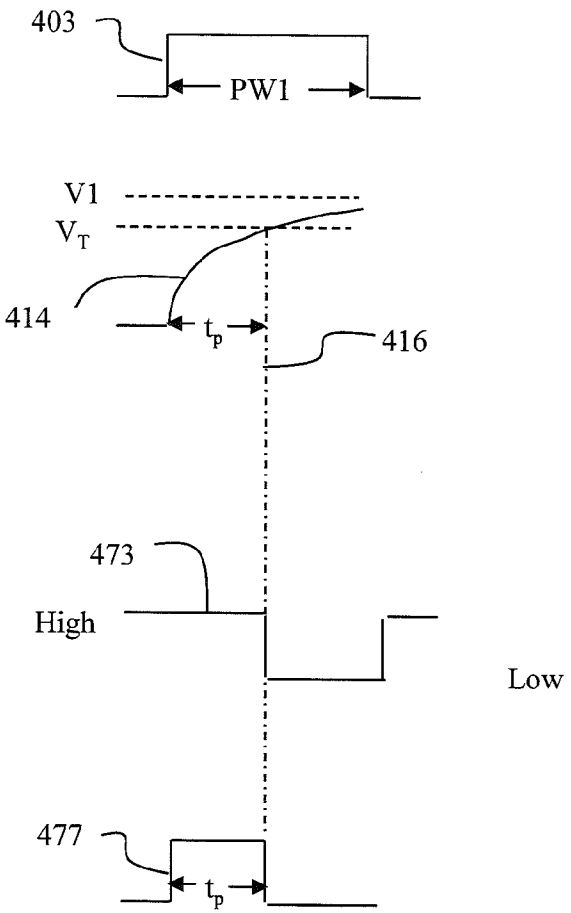
FIGS. 11A and 11B show voltage signals related to the protective circuit of FIG. 10.
Figure 11A:
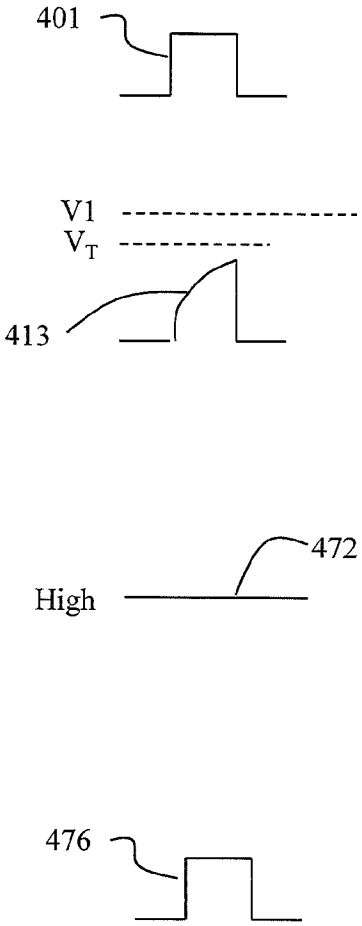

FIG. 10 shows a second embodiment of a protective circuit 450. Input 452 of protective circuit 450 is connected to the fire control pulse input 286, to first inverter 454 and to second input 462 of AND gate 460. In the absence of a fire control pulse or during the time when a fire control pulse is low, the input 451 of timer circuit 410 is high so that transistor T conducts, as described above. As a result, the output 455 of timer circuit 410 is low, so that the output 455 of second inverter 456 that is connected to first input 461 of AND gate 460 is high. When the fire control input pulse 401 is high, the input 451 of timer circuit 410 is low so that capacitor C begins to charge. For a fire control input pulse 401 that is less than the predetermined length of time (as described above), the timer circuit output pulse 413 (FIG. 11A) never reaches the trigger voltage VT of second inverter 456. As a result, the output signal 472 of second inverter 456 remains high. A fire signal control pulse 476 having the same pulsewidth PW as the fire control input pulse 401 will be provided on the output 465 (FIG. 10) of AND gate 460 (i.e. the output 465 of protective circuit 450).

However, for an excessively long fire control pulse 403 (FIG. 11A), capacitor C will have sufficient time to charge so that the timer circuit output pulse 414 (FIG. 11B) reaches trigger voltage level $V_T$ at trigger point 416. Thus beginning at trigger point 416 and through the duration of long fire control pulse 403, the output signal 473 of second inverter 456 will be low. Since output signal 473 is ANDed with long fire control pulse 403, a fire signal control pulse 477 having a pulsewidth PW equal to the predetermined length of time $t_p$ will be provided at the output 465 of protective circuit 460. A primary difference between protective circuit 450 and protective circuit 400 described above is that there is no latch in protective circuit 450, so that fire control pulses subsequent to long fire control pulse 403 will provide non-zero fire signal control pulses at output 465. If the subsequent fire control pulses are properly controlled such as long fire control pulse 403, the corresponding fire signal control pulses 476 will have the same pulsewidth PW as the long fire control pulse 403. If the subsequent fire control pulses are excessively long, such as long fire control pulse 5-4, then the corresponding fire signal control pulses 477 will have a pulsewidth PW equal to or substantially equal to the predetermined length of time $t_p$. For firmware development work, protective circuit 400 is advantaged because of its diagnostic capability described above.

The invention has been described in detail with particular reference to certain preferred embodiments thereof, but it will be understood that variations and modifications can be effected within the scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
249 Mounting substrate
250 Printhead
251 Printhead die
252 Printhead face
253 Nozzle array
253*a* Nozzle array
253*b* Nozzle array
254 Nozzle array direction
255 Resistive heater array
256 Encapsulating material
257 Flex circuit
258 Connector board
259 Bond pad(s)
262 Multi-chamber ink supply
264 Single-chamber ink supply
270 Integrated circuitry
272 Shift register element
274 Latch element
276 AND gate
278 AND gate
280 Driver transistor
281 Heater voltage input (HV)
282 Current return input (HV_RET)
285 Fire control pulse pad
286 Fire control pulse input
300 Printer chassis
301 Platen
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
314 Shaft mount (for output roller)
320 Pick-up roller
322 Turn roller
323 Idler roller
324 Output roller
325 Star wheel(s)
330 Maintenance station
370 Stack of media
371 Top piece of medium
380 Carriage motor
382 Carriage guide
383 Encoder fence
384 Belt (carriage)
390 Printer electronics board
392 Cable connectors
400 Protective circuit
401 Fire control pulse

402 First input
403 Long fire control pulse
404 Second input
405 First logic gate input
406 Logic gate (NAND gate)
407 Second logic gate input
408 Inverter
410 Timer circuit
411 Input (of timer circuit)
412 Output (of timer circuit)
413 Timer circuit output pulse
414 Timer circuit output pulse (long fire control pulse)
415 Triggerable circuit element
416 Trigger point
420 Set reset latch
421 Latch set input
422 Latch set input signal
423 Latch set input signal (long fire control pulse)
424 Input signal (AND gate)
425 Input signal (AND gate for long fire control pulse)
426 Latch reset input
427 Latch output
428 Second inverter
429 Latch output pad
430 AND gate
431 First input (to AND gate)
432 Second input (to AND gate)
435 Output (of protective circuit)
436 Fire signal control pulse
437 Fire signal control pulse (for long fire control pulse)
440 Heater voltage state indicator circuit
441 Voltage divider
442 Inverter
443 Inverter
445 Heater voltage state indicator
450 Protective circuit
451 Input (of timer circuit)
452 Input (of protective circuit)
454 First inverter
455 Output (of timer circuit)
456 Second inverter
460 AND gate
461 First input (of AND gate)
462 Second input (of AND gate)
465 Output (of protective circuit)
472 Output signal (of second inverter)
473 Output signal (of second inverter for long fire control pulse)
476 Fire signal control pulse
477 Fire signal control pulse (for long fire control pulse)
ADRL Address lines
C capacitor
H1-H16 Resistive Heaters
PW Pulsewidth
R Resistor
T Transistor
V Voltage
$V_t$ Trigger voltage
$T_p$ Length of time interval

The invention claimed is:

1. An inkjet printhead comprising:
an array of resistive heaters;
an array of nozzles associated with the array of resistive heaters;
a heater voltage input for providing a heater voltage;
a fire control pulse input for providing a fire control pulse having a first pulsewidth for controlling a length of time that current from the heater voltage input is allowed to pass through at least one of the resistive heaters; and
a protective circuit configured to receive the fire control pulse from the fire control pulse input, and to override the fire control pulse if the first pulsewidth is greater than or equal to a predetermined length of time; wherein the protective circuit includes a timer circuit having an output that is connected to a triggerable circuit element that emits a pulse having a width that is substantially equal a difference between the first pulsewidth and the predetermined length of time if the first pulsewidth is greater than or equal to the predetermined length of time, and wherein the triggerable circuit element is connected to a first input of a latch.

2. The inkjet printhead of claim 1 further comprising an integrated circuit including the array of resistive heaters, the heater voltage input, the fire control pulse input and the protective circuit.

3. The inkjet printhead of claim 1, wherein the timer circuit includes a resistor, a capacitor and a transistor.

4. The inkjet printhead of claim 1, wherein the triggerable circuit element includes at least one inverter.

5. The inkjet printhead of claim 1, wherein the triggerable circuit element includes a Schmitt trigger.

6. The inkjet printhead of claim 1, the protective circuit further including a logic gate having:
a first input connected to the fire control pulse input;
a second input connected to a heater voltage state indicator having a first state if the heater voltage is on and a second state if the heater voltage is off; and
an output that is connected to an input of the timer circuit.

7. The inkjet printhead of claim 6, wherein the logic gate is a NAND gate.

8. The inkjet printhead of claim 7, wherein the second input of the NAND gate is connected to an input of an inverter.

9. The inkjet printhead of claim 8, wherein an output of the inverter is connected to a second input of the latch.

10. The inkjet printhead of claim 9, wherein an output of the latch is connected to a first input of an AND gate.

11. The inkjet printhead of claim 10, wherein the fire control pulse input is connected to a second input of the AND gate.

12. The inkjet printhead of claim 11, wherein the output of the AND gate is the output of the protective circuit.

13. The inkjet printhead of claim 10, wherein the output of the latch is also connected to an output pad.

14. The inkjet printhead of claim 1, wherein the fire control pulse input is connected to an input of a first inverter, and wherein an output of the first inverter is connected to an input of the timer circuit.

15. The inkjet printhead of claim 14, wherein the fire control pulse input is also connected to a second input of an AND gate.

16. The inkjet printhead of claim 15, wherein an output of the timer circuit is connected to an input of a second inverter, an output of the second inverter is connected to a first input of the AND gate, and an output of the AND gate is the output of the protective circuit.

* * * * *